United States Patent [19]

Sarver

[11] 4,085,947

[45] * Apr. 25, 1978

[54] REARWARDLY CONTROLLED SNOW SKIS

[76] Inventor: John J. Sarver, 11 Carmel Bay Dr., Corona Del Mar, Calif. 92625

[ * ] Notice: The portion of the term of this patent subsequent to Feb. 15, 1994, has been disclaimed.

[21] Appl. No.: 669,643

[22] Filed: Mar. 23, 1976

Related U.S. Application Data

[63] Continuation-in-part of Ser. No. 648,140, Jan. 12, 1976, Pat. No. 4,007,946.

[51] Int. Cl.[2] ..... A63C 5/04

[52] U.S. Cl. ..... 280/607; 280/601; 280/609; 280/636

[58] Field of Search ..... 280/600, 601, 636, 607, 280/609

[56] References Cited

U.S. PATENT DOCUMENTS

| | | | |
|---|---|---|---|
| 2,929,636 | 3/1960 | Jones | 280/600 |
| 3,295,859 | 1/1967 | Perry | 280/601 |
| 3,675,938 | 7/1972 | Sigl | 280/636 |
| 3,854,739 | 12/1974 | Toda | 280/600 |

FOREIGN PATENT DOCUMENTS

| | | | |
|---|---|---|---|
| 285,338 | 4/1913 | Germany | 280/609 |
| 127,546 | 2/1950 | Sweden | 280/601 |

*Primary Examiner*—David M. Mitchell

*Attorney, Agent, or Firm*—Fulwider, Patton, Rieber, Lee & Utecht

[57] ABSTRACT

A pair of rearwardly controlled snow skis including a relatively rigid weight-bearing rear portion for mounting of ski boots thereon and projecting rearwardly from the boot heel to form a trailing portion terminating in a trailing edge. The skis project forwardly of the boot and have the top and bottom surfaces tapering inwardly toward one another to form a relatively flexible planing portion. The skis also taper outwardly along their opposite edges to form a relatively wide upturned shovel at the front extremity thereof.

11 Claims, 9 Drawing Figures

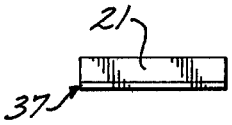
FIG. 5
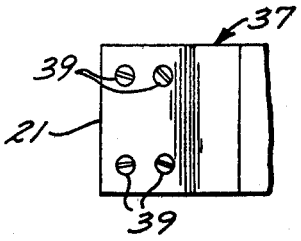
FIG. 6
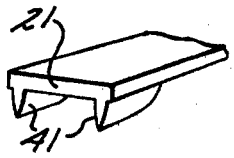
FIG. 7
FIG. 8
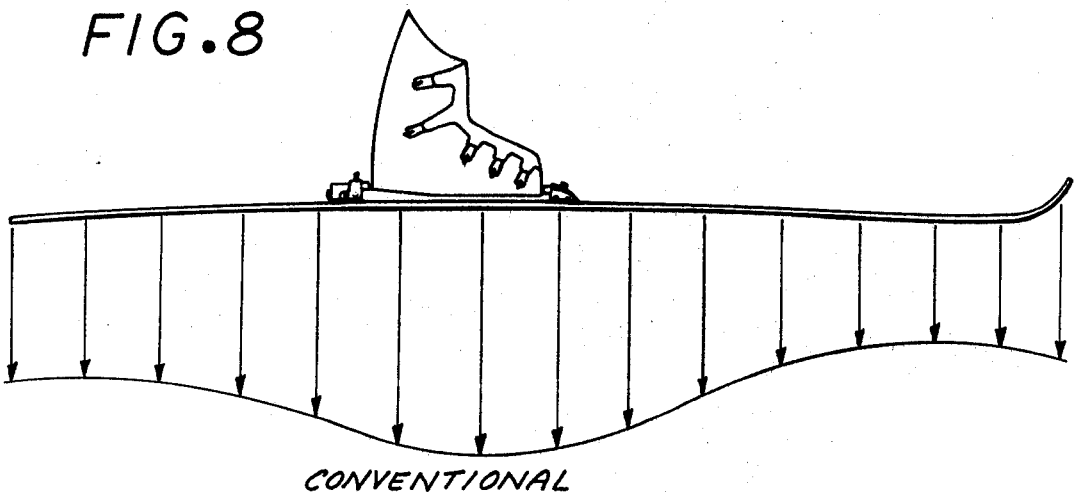
FIG. 9
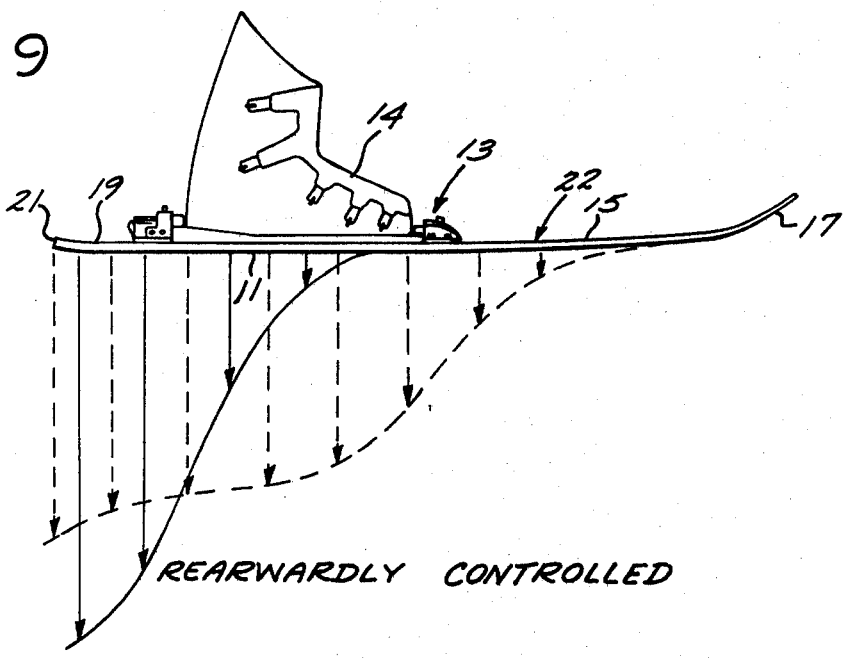

REARWARDLY CONTROLLED SNOW SKIS

CROSS REFERENCE TO RELATED APPLICATION

This application is a continuation-in-part of my application Ser. No. 648,140, filed Jan. 12, 1976, and now U.S. Pat. No. 4,007,946.

BACKGROUND OF THE INVENTION

1. Field of the Invention:

The rearwardly controlled snow ski of the present invention relates to a relatively short ski which enables the skier to practice a novel skiing technique accommodating turns wherein the ski is essentially pivoted about the rear extremity of the ski.

2. Description of the Prior Art:

As described in my aforementioned patent, the evolution of skiing has led to current day parallel skiing wherein turns are accomplished in a number of different styles, one of which involves shifting of the weight abruptly forwardly on the skis in order to swing the tails of the skis to one side about the more forward portion of the skis, thus accommodating the turn to the side opposite such one side. Other styles emphasize merely sliding the tails of the skis away from the direction of the turn and further styles even emphasize unweighting of the tips of the skis in what is known as a "jet turn". Skis commonly used in these various styles of skiing generally incorporate a ski constructed of metal, fiber glass or the like to assume a camber wherein the central portion of the ski is self-biased to a raised position elevated slightly from the opposite ends of the ski and having mounted thereon bindings for receiving the skier's boots. Efforts have been made to simplify the teaching of skiing by a technique known as a graduated length method (GLM) wherein a skier initially begins on shorter skis, as for instance skis in the neighborhood of 100 centimeters long and even shorter, and then advances to longer skis as his skills develop, such GLM skis being conventionally shaped and of conventional flexibility throughout their length. While all of the aforedescribed skis offer great enjoyment for the skier, they are all characterized by central location of the ski binding in a forward-aft direction on the ski and by the fact that they are all formed with tails projecting rearwardly of the binding and having a length nearly equal to the leading portion of the ski projecting forwardly of the binding, with both such tail and leading portions having substantially the same flexibility. Such design characteristics extremely limit the ski performance, thus preventing the skier from performing styles of turns wherein the ski itself essentially pivots about the tail of the ski and requiring the tail to always be shifted to one side or the other relative to the remainder of the ski while a turn is being accommodated. Further, such prior art skis provide substantially equal balance between the front and rear of the skis and fail to mount the skier rearwardly on the ski to enable the flexibility of the leading ski portion to lead the way over irregularities and obstacles without the resistance normally offered by the leverage exhibited the ski tail.

SUMMARY OF THE INVENTION

The rearwardly controlled snow ski of the present invention is characterized by a configuration mounting the ski binding rearwardly on the ski over a relatively rigid weight-bearing portion for receipt thereon of the skier's boot and having a flexible leading portion projecting forwardly therefrom to turn rather abruptly upwardly at its forward extremity to form a ski shovel. A short trailing portion may extend rearwardly of the weight-bearing portion but in no instance should extend rearwardly from the skier's heel a distance greater than 20% of the length of the planing portion projecting forwardly of the skier's toe. The forward planing portion may curve gradually forwardly and upwardly from the weight-bearing portion to the abruptly upturned shovel to provide a camber which is reversed in comparison to conventional ski cambers to enable such planing portion to project forwardly and upwardly with respect to the weight-bearing portion to thereby prevent hooking thereof and give excellent tracking characteristics.

DESCRIPTION OF THE DRAWINGS

FIG. 5 is a partial end view, in enlarged scale, of the trailing portion of the ski shown in FIG. 4;

FIG. 6 is a bottom view of the trailing portion shown in FIG. 5;

FIG. 7 is a perspective view of the trailing portion of a third embodiment of the ski of present invention;

FIG. 8 is a force distribution diagram associated with the operation of a conventional ski; and FIG. 9 is an elevational view of the ski shown in FIG. 1 and force distribution diagram associated therewith.

DESCRIPTION OF THE PREFERRED EMBODIMENTS

Figure 1:
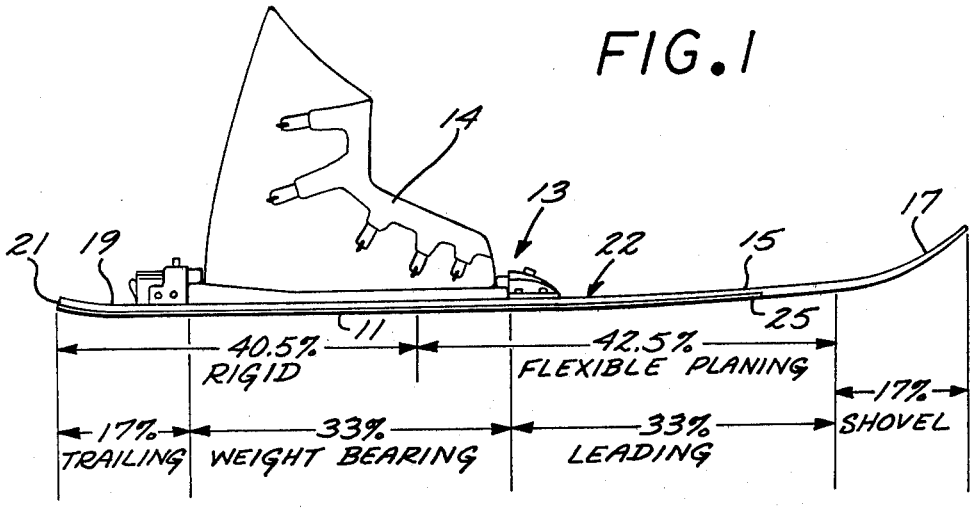
FIG. 1 is a side elevational view of a ski embodying the present invention.
Figure 2:
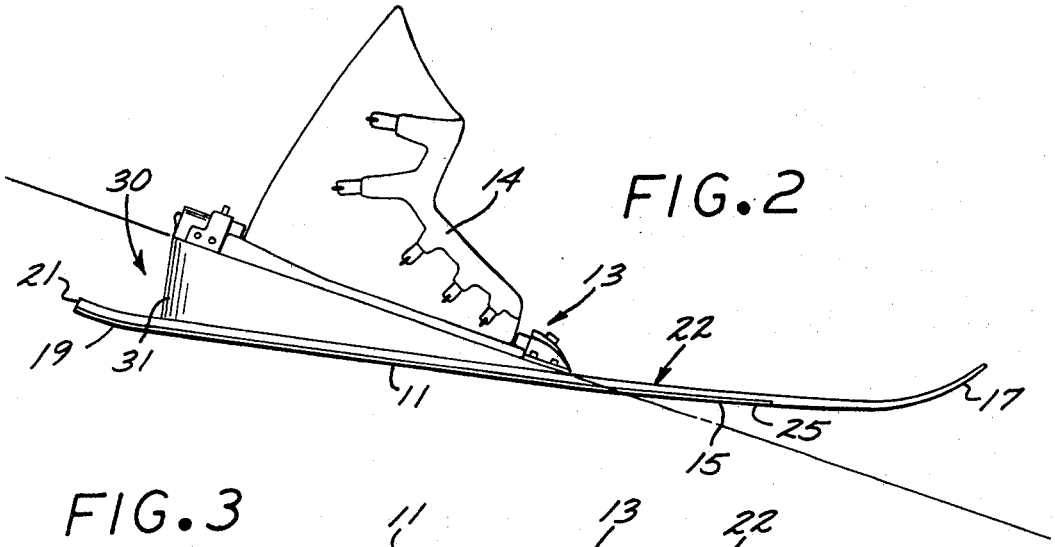
FIG. 2 is a side elevational view similar to FIG. 1 but showing a heel-elevated binding mounting on such ski.
Figure 3:
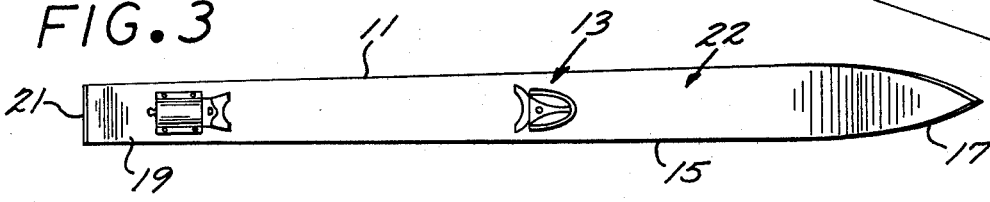
FIG. 3 is a top plan view, in enlarged scale, of the ski shown in FIG. 1.

Referring to FIG. 1, the rearwardly controlled ski of the present invention has an overall appearance somewhat similar to conventional skis except that the ski which is intended for use by both children and adults is only about 106 centimeters long and about 10 centimeters wide and is formed with a medial rigid weight-bearing portion 11 having a conventional ski binding 13 mounted directly thereover and normally spanning approximately 32% of the overall length of the entire ski to receive a ski boot 141. Projecting forwardly from the weight-bearing portion 11 is a relatively flexible leading portion 15 which curves upwardly slightly for approximately 32% of the overall length then curves abruptly upwardly to form within about 17% of the forwardmost portion a conventionally shaped shovel 17. Projecting rearwardly from the rear end of the medial weight-bearing portion 11 is a trailing portion 19 which is also relatively rigid and constitutes approximately 17% of the overall ski length terminating at its rear end in a trailing edge 21. Consequently, the skier's weight is positioned rearwardly on the ski itself thus enabling the flexible leading portion 15 to ridge above the snow surface and act to negotiate various undulations and obstacles appearing over the ski course and the skier himself may initiate a turn by merely rolling his knees in the direction of the turn thus causing the rear edge 21 to dig into the snow on the side of the skis toward which his knees have rolled thus causing the leading portion 15 of the ski to be drawn sideways in the direction of the turn thereby causing the ski to, in essence, pivot about the heel of the skier with very little, if any, resistance thereto being offered by the trailing portion 19 or the front portion 15.

Typically, adult skis are on the order of 185 centimeters long and longer with a maximum width of about 8 to 9 centimeters and are formed with a self-biasing camber causing the longitudinal medial portion thereto to be raised slightly with respect to the leading and trailing ends of the ski. The weight-bearing portion of the ski is conventionally located medially along the fore-aft length of the ski with the tail of the ski being only slightly less flexible than the leading portion thereof. Consequently, typical skiing techniques on such conventional skis result in the ski itself being rotated either about the median portion thereof during a turn or about a portion somewhat forwardly of the ski binding. These skiing techniques have led to many teaching methods emphasizing a skier keeping his weight forward on the ski and even tending to shift his weight abruptly upwardly and forwardly when coming into a turn in order to raise the tails of the skis momentarily off the ski trail while simultaneously shifting the tails to one side in a direction opposite the direction of the turn in order to facilitate such pivoting of the ski about a forward portion thereof. Heretofore, there have been no efforts to provide a snow ski which essentially pivots about the trailing extremity thereof and provides for the weight of the skier being borne rearwardly of the ski median leaving the flexible leading portion of the ski free to plane over the ski terrain thus leading the weight-bearing portion gradually over obstacles and undulations encountered on the ski trail.

While the particular ski shown in FIG. 1 is 106 centimeters long, it will be understood that the length of such ski, while being shorter than conventional adult skis, will vary in length from approximately 90 centimeters to approximately 110 centimeters. It is only important that the weight-bearing portion 11 be formed rearwardly on the ski, that the trailing portion 19 not exceed 20% of the overall ski length and that the leading portion 15 and be relatively flexible to enable upward and downward flexing thereof as the ski maneuvers over the ski trail.

In order to support an adult skier's weight on the 106 centimeter ski, the ski is formed with a width approximately 10% greater than that of conventional skis and to enhance tracking and the planing effect of the leading portion 15 to the widest portion thereof, immediately behind the shovel 17, is approximately 10 centimeters wide and tapers rearwardly and inwardly therefrom to the trailing portion 19 which is approximately 8.5 centimeters wide. The widest section of the planing portion 15 must be approximately 10 centimeters wide for adult skiers.

The weight-bearing and trailing portions 11 and 19 are substantially rigid for 40.5% of the overall ski length to maintain their straight planar configuration when weight is applied thereto and commence curving gradually upwardly and forwardly from the horizontal plane thereof at a gradually decreasing radius of curvature from a point directly beneath the ball of the boot 14 and continue such upward curvature for 42.5% of the ski length to form a planing portion, generally designated 22, which is, in essence, reverse cambered to be raised in its unflexed condition, to 0.5 centimeters about the plane of the weight-bearing portion 11 at the base of the shovel 17. While the reverse camber of such planing portion 22 may be sufficient to raise the front thereof several centimeters off the snow it should be sufficient to raise it at least 0.3 centimeters and preferably 0.5 centimeters. Such planing portion 22 becomes gradually more flexible as it projects forwardly and incorporates the leading portion 15. Such planing portion 22 must exceed 35% of the overall ski length for proper ski performance. In skiing steep slopes the entire weight of the skier may at times be borne by such trailing edge 21 so it is important from a performance standpoint that the trailing portion be relatively short, not exceeding 20% of the ski length and preferably no more than 17% of the overall ski length. Also since the trailing edge 21 acts as a third edge it should incorporate a metallic edge or other wear resistant covering to be discussed hereinafter.

The ski may be constructed as set forth in my aforementioned parent application to incorporate longitudinally extending spaced apart I-beams of extruded polystyrene and wrapped with layers of various different weaves of fiber cloth pre-impregnated with resin with the space between such I-beams being filled with expanded urethane foam. The sides of the ski are closed by adhering plastic strips to the ends of the impregnated fiber cloth and elongated steel strips are secured to the opposite sides of the ski to form edges 25. The longitudinal I-beams may gradually decrease-in-cross section toward the forward extremity of the planing portion 15 to thereby gradually increase the flexibility of such planing portion thus providing the greater relative flexibility with respect to the weight-bearing and trailing portions 11 and 19.

In operation, the ski binding 13 may be of conventional construction and is mounted over the weight-bearing portion 11 with the toe thereof being positioned approximately medially in a fore-aft direction on the ski. The skier's boot will then be received in such binding and in standing on such ski his weight will be positioned rearwardly on the ski thus distributing his weight in a gradually increasing magnitude toward the rear of the ski as depicted by the broken line force diagram shown in FIG. 9.

This weight distribution should be contrasted with that for a conventional ski as shown in FIG. 8 wherein the weight-bearing portion is located centrally in a fore-aft direction and the ski is formed with a conventional camber raising the central portion thereof relative to the shovel and tail. Consequently, as the skier skis down the ski slope, the relatively unweighted shovel 17 and planing portion 22 will encounter various obstacles and unevenness in the terrain and will flex upwardly and downwardly in response to such encounter, thus leading the weight-bearing portion over the obstacles. It will be appreciated that such flexing of the planing portion 22 will not only absorb shock and forces resulting from consequent changes in direction as dictated by such obstacles, but will essentially telegraph forces applied thereto to the skier's foot, thus providing advance notice of the expected encounter with such obstacles by the weight-bearing portion 11 thereby giving the skier an opportunity to anticipate sudden changes in direction, speed and the like.

It will be appreciated that with the weight positioned rearwardly on the ski, there is no necessity for the skier to make extra effort to manipulate his body in such a manner as to unweight the tails of the ski during turning maneuvers, thus enabling the skier to utilize an entirely new skiing technique in negotiating a turn. Surprisingly, a mere rolling to one side of the skier's knees will cause the edges of the skis on such one side to be weighted and with the weights positioned rearwardly on the ski, the rear corner of the trailing edge 21 on such one side will dig into the snow, thus tending to draw the planing portion 15 of the ski to such one side thereby causing the ski itself to pivot about the skier's heel, thereby negotiating such turn. This turning maneuver can be further facilitated by the skier shifting his weight even further rearwardly on the skis, as by assuming a nearly sitting position, thus applying even more weight to the trailing edge 21 as depicted by the solid line force distribution diagram shown in FIG. 9 to thereby exaggerate the braking effect of the corner digging into the snow and further sharpening the curvature of the turn.

It has been found that in normal skiing over relatively hard-packed snow, the planing portion 22 may project upwardly from the plane of the snow at an angle of approximately seven degrees, thus causing the forwardmost portion thereof to only encounter rises in the terrain itself and to normally be elevated from the snow surface. However, when the skier is skiing down an extremely steep slope or skiing through soft powder, the planing portion 22 may project from the snow surface at an angle of 80° or more, as shown in FIG. 4.

The flexibility of the planing portion 22 enables the leading extremity thereof to flex upwardly to facilitate plowing through soft powder while the rigid trailing portion 19 enables the skier to dig the trailing edge 21 into either hard or loose snow on a steep slope to thus act as a highly effective brake enabling the skier to maneuver essentially straight down an extremely steep slope, even up to an 80° incline, without making significant contact of the underside of the planing portion 22 with the snow. Consequently, the combination of the rigid weight-bearing and trailing portions 11 and 19 with the flexible planing portion 22 exhibits an entirely new ski performance heretofore unknown.

Because of the nature of the skis being rearwardly controlled, the skier normally assumes a position leaning further rearwardly from the vertical than for normal skis in order to apply greater pressure on the third edge of the ski. This position may lead to early fatigue or eventual discomfort so it is desirable to provide a new ski binding, generally designated 30, which incorporates a support wedge 31 which acts to elevate the heel of the boot relative to the toe itself, thus enabling the skier to maintain his weight rearwardly on the trailing portion without assuming a skiing position angling his body excessively rearwardly of the vertical. It will be appreciated that the angular binding support may take many different forms, as shown in my aforementioned co-pending application, and the wedge type support 31 is merely shown as a representative embodiment.

Figure 4:
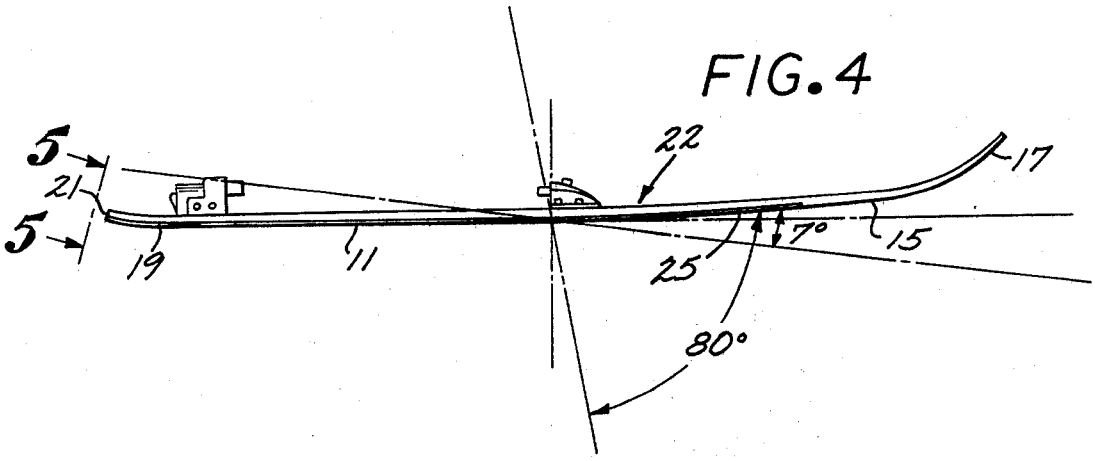
FIG. 4 is an elevational view of a second embodiment of the ski of the present invention.

Referring to FIGS. 4, 5 and 6, the trailing edge 21 may be formed by the rear edge of a pressure plate, generally designated 37, which is received in a relief formed in the underside of the trailing portion 19 and is removably secured thereto by means of screws 39 so the pressure plate may be removed and replaced with different pressure plates having other configurations and characteristics for different snow conditions and intended use.

Referring to FIG. 7, the pressure plate may be formed with one or more longitudinal downwardly projecting skegs 41 to enhance maneuverability and facilitate control, it being appreciated that in many instances the longitudinal edges 25 of the ski may have little contact with the snow, thus placing great emphasis on such pressure plate for control.

From the foregoing, it will be apparent that the ski of present invention exhibits characteristics enabling a skier to ski a totally new style of skiing whereby a relatively unaccomplished skier may accommodate what were heretofore considered extremely challenging slopes and adverse snow conditions. A relatively unaccomplished skier will not be plagued by the feeling of awkwardness normally accompanying the learning to master skis having rather lengthy tails projecting substantial distances rearwardly of the binding and offering resistance to turning of the ski. Because of the rearward control a ski in the 100 centimeter range will be suitable for use by both male and female adults thus eliminating the necessity of carefully selecting the ski length in accordance with the physical size of the skier.

Various modifications and changes may be made with regard to the foregoing detailed description without departing from the spirit of the invention.

I claim:

1. A pair of rearwardly controlled snow skis for mounting ski bindings thereon for receipt of ski boots, each ski comprising:

a relatively rigid weight-bearing rear portion for mounting of said ski bindings to position the boot received therein with the toe and heel over the respective front and rear of said weight-bearing portion, said ski projecting rearwardly to form a trailing portion projecting rearwardly of the heel of said boot a distance no greater than 17% of the overall ski length and terminating in a trailing edge and further projecting forwardly to form a relatively flexible planing portion turned upwardly at its front extremity to form a shovel, the bottom surfaces of said rear and planing portions being substantially flat to facilitate shifting from side-to-side of said ski and having a substantially continuous downwardly facing longitudinal contour; and the top and bottom surfaces of said planing portion tapering gradually and continuously forwardly and inwardly toward one another to form a relatively thick aft-end joined with said weight-bearing portion and narrowing to a relatively thin forward end joined with said shovel, the lateral sides of said ski further tapering inwardly and rearwardly from the width of said shovel to terminate at said trailing portion in a relatively narrow aft-end, the total length of said ski being at least 90 centimeters.

2. A pair of skis as set forth in claim 1 wherein:

said trailing portion is substantially planar.

3. A pair of skis as set forth in claim 1 wherein: said ski is at least 9.5 centimeters wide.

4. A pair of skis as described in claim 1 that includes:

binding means including means to dispose the heel of the skier's boot at a predetermined angular elevation above and with respect to the toe of the boot.

5. A pair of skis as described in claim 4 wherein:

the means to elevate the heel of the skier's boot comprises a triangular wedge.

6. A pair of skis as set forth in claim 1 wherein:

said planing portion constitutes at least 35% of the length of said ski.

7. A pair of skis as set forth in claim 1 wherein:

said trailing portion constitutes substantially 17% of the length of said ski.

8. A pair of skis as set forth in claim 1 wherein:

said planing portion constitutes substantially 42.5% of the overall ski length.

9. A pair of skis as set forth in claim 1 that includes:

a wear resistant pressure plate mounted on the underside of said trailing portion.

10. A pair of skis as described in claim 9 that includes:

means for removably mounting said pressure plate so it can be removed and replaced by a differently contoured pressure plate for different snow conditions.

11. A pair of rearwardly controlled snow skis as set forth in claim 1 wherein:

said trailing portion projects rearwardly of said heel a distance no greater than one-third the length of said planing portion.

* * * * *